US010751760B2

(12) United States Patent
Shi

(10) Patent No.: US 10,751,760 B2
(45) Date of Patent: Aug. 25, 2020

(54) WIPING MECHANISM AND SUBSTRATE CLEANING APPARATUS

(71) Applicant: Wuhan China Star Optoelectronics Technology Co., Ltd., Wuhan, Hubei (CN)

(72) Inventor: Jie Shi, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 348 days.

(21) Appl. No.: 15/749,423

(22) PCT Filed: Jan. 10, 2018

(86) PCT No.: PCT/CN2018/072129
§ 371 (c)(1),
(2) Date: Jan. 31, 2018

(87) PCT Pub. No.: WO2019/114076
PCT Pub. Date: Jun. 20, 2019

(65) Prior Publication Data

US 2020/0086356 A1 Mar. 19, 2020

(30) Foreign Application Priority Data

Dec. 13, 2017 (CN) ..... 2017 1 1331296

(51) Int. Cl.
*B08B 1/00* (2006.01)
*B08B 1/02* (2006.01)
(Continued)

(52) U.S. Cl.
CPC ..... *B08B 1/002* (2013.01); *B08B 1/02* (2013.01); *B08B 3/022* (2013.01); *B08B 13/00* (2013.01)

(58) Field of Classification Search
CPC ..... B08B 1/02; B08B 1/002; B08B 3/022; B08B 3/04; B08B 3/041; B08B 13/00; H01L 21/67046; H01L 21/67051
(Continued)

(56) References Cited

U.S. PATENT DOCUMENTS 2,015,583 A * 9/1935 Bartsch ..... B08B 1/02 15/308
6,041,465 A * 3/2000 Yashiki ..... B08B 1/04 15/102

FOREIGN PATENT DOCUMENTS

CN 101130187 A 2/2008
CN 101146410 A 3/2008
(Continued)

OTHER PUBLICATIONS

Computer generated English translation of JP 2008-049263 A, Moriguchi et al., Mar. 2008. (Year: 2008).*
(Continued)

*Primary Examiner* — Laura C Guidotti
(74) *Attorney, Agent, or Firm* — Hemisphere Law, PLLC; Zhigang Ma

(57) ABSTRACT

A wiping mechanism is provided for wiping a substrate during transmission. The wiping mechanism comprises an upper wiping unit and a lower wiping unit moving back and forth for separately wiping an upper side and a lower side of the substrate. The moving directions of the upper wiping unit and the lower wiping unit are parallel to a loading plane for disposing the substrate and vertical to a transmission direction of the substrate, and the moving directions of the upper wiping unit and the lower wiping unit are opposite to each other, thereby to prevent the substrate being shifted due to wiping, to guarantee the effect of cleaning foreign particles from the surface of the substrate and to avoid scratching the surface of the substrate, to prevent the cleaning
(Continued)

apparatus from being damaged, and to avoid affecting the substrate transmission. A substrate cleaning apparatus is also provided.

17 Claims, 2 Drawing Sheets

(51) Int. Cl.
*B08B 13/00* (2006.01)
*B08B 3/02* (2006.01)

(58) Field of Classification Search
USPC ..... 15/77, 88.1, 100, 102
See application file for complete search history.

(56) References Cited

FOREIGN PATENT DOCUMENTS

| | | | |
|---|---|---|---|
| CN | 101441987 | A | 5/2009 |
| CN | 101554628 | A | 10/2009 |
| CN | 102099128 | A | 6/2011 |
| CN | 104856628 | A | 8/2015 |
| CN | 206588043 | U | 10/2017 |
| JP | 2003-39026 | A | 2/2003 |
| KR | 10-0884732 | B1 | 2/2009 |

OTHER PUBLICATIONS

Computer generated English translation of CN 206588043 U, Qiu, Oct. 2017. (Year: 2017).*

* cited by examiner

WIPING MECHANISM AND SUBSTRATE CLEANING APPARATUS

RELATED APPLICATIONS

The present application is a National Phase of International Application Number PCT/CN2018/072129, filed Jan. 10, 2018, and claims the priority of China Application No. 201711331296.5, filed Dec. 13, 2017.

BACKGROUND OF THE INVENTION

1. Field of the Invention

The disclosure relates to a display technical field, and more particularly to a wiping mechanism and a substrate cleaning apparatus.

2. The Related Arts

The wet washing apparatuses in TFT-LCD industry all use the brush structures for cleaning the upper and lower surfaces of the substrate. The most common brush is the roller brush. Its theory is using the rotation of the roller brush to make the fluff tips contact the surface of the substrate for disturbing and brushing off the foreign particles on the surface of the substrate.

The structure of conventional roller brush usually includes a brush, a driving part and a gap controlling part for adjusting the gap between the brush and the substrate. The brush is disposed rotatably on the substrate, the driving part is applied for driving the brush to rotate. At the same time, the gap between the brush and the substrate is adjusted by the gap controlling part to guarantee the damping force between the brush and the substrate. It is difficult to control the strength by this kind of gap controlling scheme, so the structure of apparatus is more complicated. Besides, following the development of display industry, the demand for the fabrication of substrate is more and more high, therefore a lot of problems occurred in the usage of current roller brush. For example, it is required to fabricate the roller brush and the live roller together, the structure thereof is bulky and has linear contact with the substrate only at the tangential position. Therefore, it is difficult to have better cleaning effect due to the smaller contact area. Further, for guaranteeing the damping force between the brush and the substrate, it is necessary to increase the strength for pushing the brush on the substrate, thereby to cause the scratches easily occurring on the substrate. The more strength would affect the transferring velocity of the substrate and even interrupt the transmission, or cause the apparatus damaged due to overloading of the driving part.

SUMMARY

For overcoming the deficiency of current technology, the present invention provides a wiping mechanism and a substrate cleaning apparatus, to guarantee the effect of cleaning foreign particles from the surface of the substrate and at the same time to avoid scratching the surface of the substrate, also to prevent the cleaning apparatus from being damaged and to avoid affecting the substrate transmission.

For achieving the above objective, the technical schemes as follows are applied in the present invention.

A wiping mechanism, applied for wiping a substrate during transmission, comprises an upper wiping unit and a lower wiping unit moving back and forth for separately wiping an upper side and a lower side of the substrate. The moving directions of the upper wiping unit and the lower wiping unit are parallel to a loading plane for disposing the substrate and vertical to a transmission direction of the substrate, and the moving directions of the upper wiping unit and the lower wiping unit are opposite to each other.

In one embodiment, the upper wiping unit and the lower wiping unit both include a backplate far away the substrate and a wiping part fastening on an inner surface of the backplate, for contacting the backplate.

In one embodiment, the wiping part is bristles.

In one embodiment, the wiping mechanism further comprises a left stand and a right stand disposed at two sides of the transmission direction of the substrate, wherein the upper wiping unit includes first connecting axles connected separately to two sides of the backplate, and the lower wiping unit includes second connecting axles connected separately to two sides of the backplate, the first connecting axles at two sides of the upper wiping unit and the second connecting axles at two sides of the lower wiping unit are individually plugged in and supported by the left stand and the right stand.

In one embodiment, the wiping mechanism further comprises sleeves for individually slipping over each the first connecting axle and each the second connecting axle, wherein the sleeves are embedded and fastened in the corresponding left stand and the corresponding right stand.

In one embodiment, the wiping mechanism further comprises a fixed base fastened on one side of the right stand and a linkage rod rotatably connected to the fixed base at a middle portion of the linkage rod, wherein two sides of the linkage rod are separately hinge connected to the first connecting axle and the second connecting axle adjacent to the linkage rod.

In one embodiment, the wiping mechanism further comprises a sliding base connected with an end of one of the first connecting axles, a cam rotor embedded in the sliding base and a motor for driving the cam rotor to rotate, wherein the sliding base has a groove formed thereon, and a depth direction of the groove is vertical to the first connecting axle, the cam rotor is driven by the motor to rotate in the groove for driving the sliding base moving back and forth along an axial direction of the first connecting axle.

In one embodiment, the wiping mechanism further comprises a connecting rod and an axle coupling unit, wherein one end of the connecting rod is connecting to the sliding base and another end of the connecting rod is connecting to the first connecting axle through the axle coupling unit.

In one embodiment, the wiping mechanism further comprises an auxiliary stand, wherein the connecting rod is disposed to pass through inside the auxiliary stand and is supported by the auxiliary stand.

The present invention also provides a substrate cleaning apparatus. The substrate cleaning apparatus comprises a substrate transferring mechanism, a spraying mechanism and the above wiping mechanism. The substrate transferring mechanism is for loading and transferring the substrate. The spraying mechanism is disposed above the substrate transferring mechanism for spraying cleaning fluid on the substrate before the substrate is passing through the wiping mechanism.

In the present invention, by disposing the upper wiping unit and the lower wiping unit individually at the upper side and the lower side of the substrate to move back and forth for separately wiping the substrate, the moving directions of the upper wiping unit and the lower wiping unit are parallel to the loading plane for disposing the substrate and are vertical to a transmission direction of the substrate, and the moving directions of the upper wiping unit and the lower wiping unit are opposite to each other, thereby to prevent the substrate being shifted due to wiping, to guarantee the effect of cleaning foreign particles from the surface of the substrate and at the same time to avoid scratching the surface of the substrate, to prevent the cleaning apparatus from being damaged, and to avoid affecting the substrate transmission.

DETAILED DESCRIPTION OF THE PREFERRED EMBODIMENTS

In order to understand the above objectives, features and advantages of the present disclosure more clearly, the present disclosure is described in detail below with references to the accompanying drawings and specific embodiments. However, the disclosure can be embodied in many forms of substitution, and should not be interpreted as merely limited to the embodiments described herein.

Figure 1:
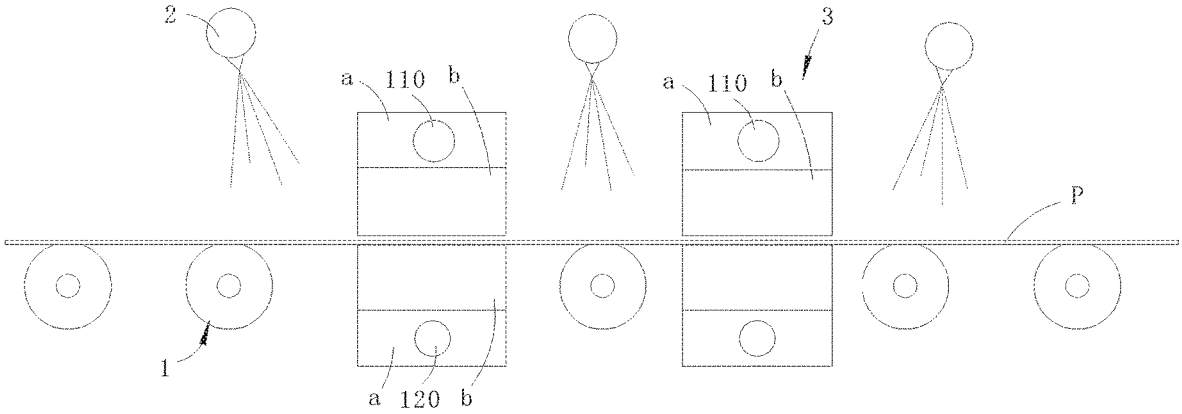
FIG. 1 is a structure view of the substrate cleaning apparatus in an embodiment of the present invention.

Referring to FIG. 1, the substrate cleaning apparatus provided by the present invention comprises a substrate transferring mechanism 1, a spraying mechanism 2 and a wiping mechanism 3. The substrate transferring mechanism 1 is applied for loading and transferring the substrate P. The spraying mechanism 2 is disposed above the substrate transferring mechanism 1 for spraying cleaning fluid, such as pure water or chemical cleaner, on the substrate P before the substrate P is passing through the wiping mechanism 3. Namely, the spraying mechanism 2 is disposed before the wiping mechanism 3 along the transmission direction of the substrate, so during the substrate transmission the substrate would be sprayed cleaning fluid first by the spraying mechanism 2 and then be wiped. The substrate transferring mechanism 1 includes multiple transferring rollers disposed with a spacing from each other. All the transferring rollers have the same specifications, and the contact surfaces of the axes and the substrate are arranged on the same horizontal plane. Both the spraying mechanism 2 and the wiping mechanism 3 are multiple, and it is better to dispose these spraying mechanisms 2 and wiping mechanisms 3 alternatively from the upstream to downstream along the transmission direction of the substrate, like the spraying mechanism 2—the wiping mechanism 3—the spraying mechanism 2—the wiping mechanism 3—the spraying mechanism 2 . . . , for achieving the better wiping effect.

In this embodiment, the wiping mechanism 3 is applied for wiping the substrate P during transmission. Also referring to FIG. 2, the wiping mechanism 3 comprises an upper wiping unit 11 and a lower wiping unit 12 moving back and forth for separately wiping an upper side and a lower side of the substrate P. The moving directions of the upper wiping unit 11 and the lower wiping unit 12 are parallel to a loading plane for disposing the substrate P and vertical to the transmission direction of the substrate P. The moving directions of the upper wiping unit 11 and the lower wiping unit 12 are always opposite to each other. The upper wiping unit 11 and the lower wiping unit 12 both are made of a long bar structure. When contacting and wiping the substrate P, the upper wiping unit 11 and the lower wiping unit 12 both are across the surfaces of the substrate P. Namely, one upper wiping unit 11 could cover totally the surface of the substrate P along the width direction.

By this arrangement, the substrate P is transferred along the horizontal direction, and the upper wiping unit 11 and the lower wiping unit 12 are wiping the substrate P separately along the opposite directions. Therefore, the horizontal wiping forces between the two wiping units and the substrate P are cancelled out each other, and the substrate P would not be shifted form the wiping direction, thereby to prevent the substrate transmission from the influence in the conventional wiping scheme of being unable to control the wiping force precisely caused by wiping the substrate along the substrate transmission direction or the opposite direction thereto.

Figure 2:
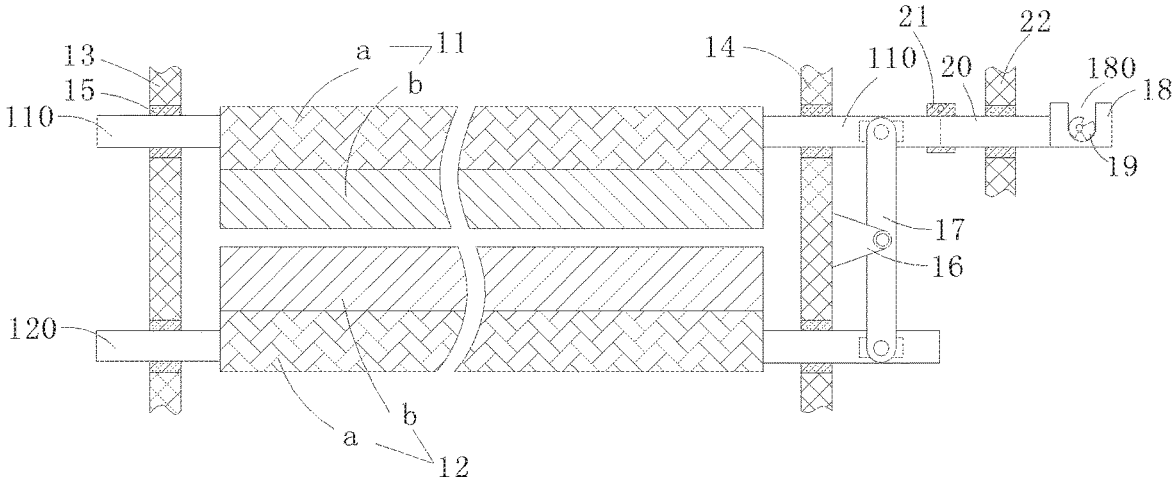
FIG. 2 is a cross-section view of the wiping mechanism in an embodiment of the present invention.

As shown in FIG. 2, the structures of the upper wiping unit 11 and the lower wiping unit 12 are substantially the same. The upper wiping unit 11 and the lower wiping unit 12 both include a backplate (a) far away the substrate P and a wiping part (b) fastening on an inner surface of the backplate (a), for contacting the backplate (a). The wiping part (b) is bristles. The wiping mechanism 3 further comprises a left stand 13 and a right stand 14 disposed at two sides of the transmission direction of the substrate P, multiple sleeves 15 embedded and fastened in the corresponding left stand 13 and the corresponding right stand 14. The upper wiping unit 11 includes first connecting axles 110 connected separately to two sides of the backplate (a), and the lower wiping unit 12 includes second connecting axles 120 connected separately to two sides of the backplate (a). The first connecting axles 110 at two sides of the upper wiping unit 11 and the second connecting axles 120 at two sides of the lower wiping unit 12 are individually plugged in and supported by the left stand 13 and the right stand 14. In specific, the sleeves 15 are individually slipping over the surfaces of each the first connecting axle 110 and each the second connecting axle 120, and the sleeves 15 are embedded and fastened in the corresponding left stand 13 and the corresponding right stand 14. The sleeves 15 have a running fit with the corresponding first connecting axle 110 and the corresponding second connecting axle 120. When the upper wiping unit 11 and the lower wiping unit 12 are wiping back and forth, the first connecting axle 110 and the second connecting axle 120 are reciprocally sliding in the corresponding sleeves 15 individually.

Figure 3:
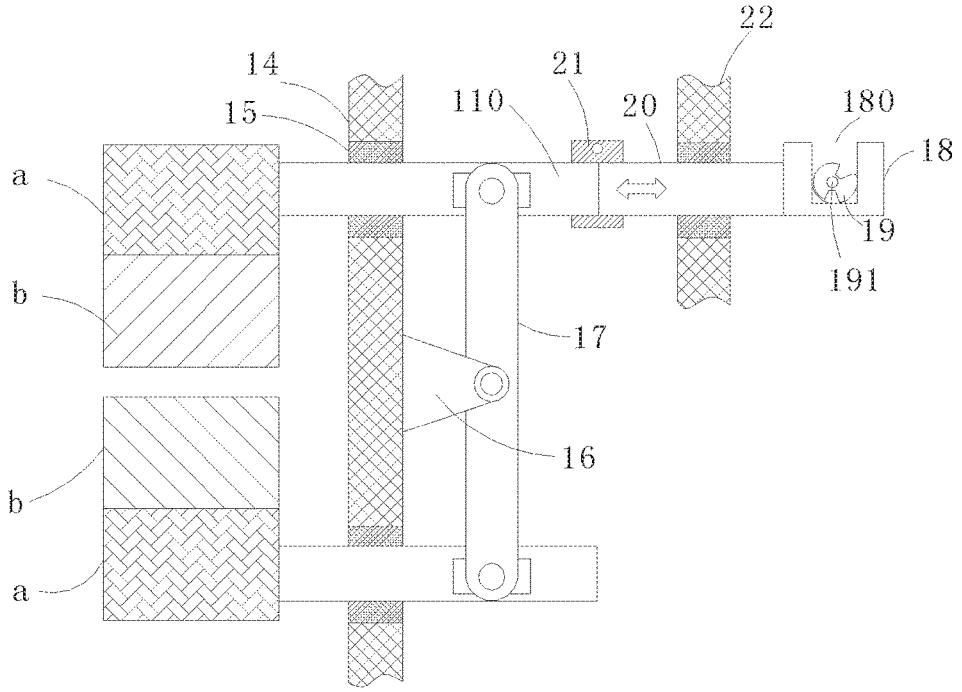
FIG. 3 is a local structure view of FIG. 2.
Figure 4:
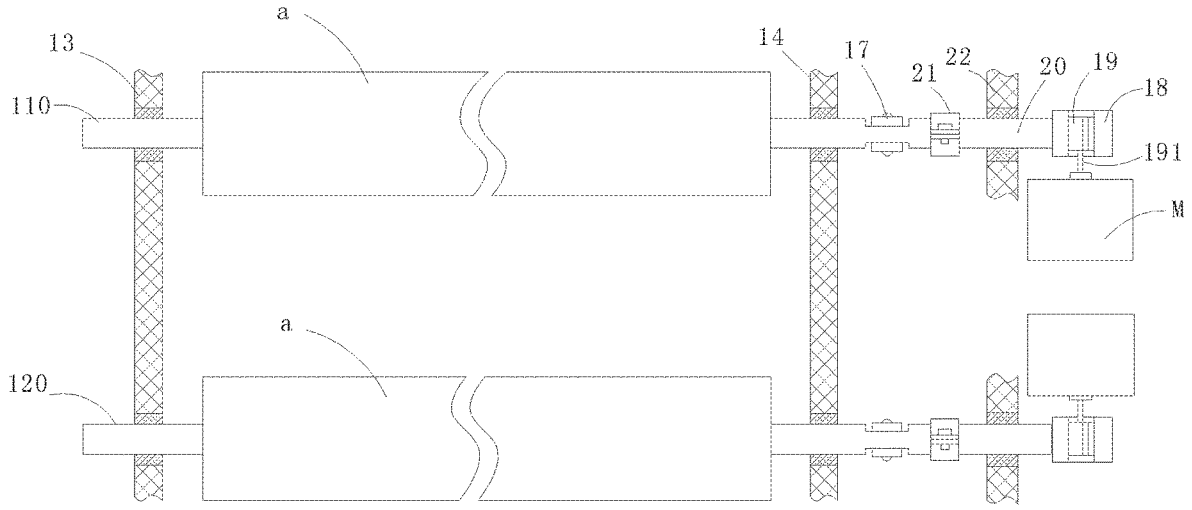
FIG. 4 is a cross-section view of the wiping mechanism along the horizontal direction in an embodiment of the present invention.

Referring to FIG. 2 to FIG. 4, for guaranteeing the motion compatibility of the upper wiping unit 11 and the lower wiping unit 12, the wiping mechanism 3 further comprises a fixed base 16 fastened on one side of the right stand 14 and a linkage rod 17 rotatably connected to the fixed base 16 at a middle portion of the linkage rod 17. Two sides of the linkage rod 17 are separately hinge connected to the first connecting axle 110 and the second connecting axle 120 adjacent to the linkage rod 17. The fixed base 16 is fixed on the right stand 14, so when one of the upper wiping unit 11 and the lower wiping unit 12 is performing the wiping, the linkage rod 17 would drive the other wiping unit to move in an opposite direction for performing the wiping, thereby to guarantee that the moving directions of the upper wiping unit 11 and the lower wiping unit 12 are always opposite to each other and the upper wiping unit 11 and the lower wiping unit 12 always have concerted action sensitively.

For achieving the driving to the wiping mechanism 3, in this embodiment, a sliding base 18 is connected to an end of one of the first connecting axles 110 of the upper wiping unit 11, a cam rotor 19 is embedded in the sliding base 18, and a motor M is connected with a camshaft of the cam rotor 19 for driving the cam rotor 19 to rotate. The sliding base 18 has a groove 180 formed thereon, and a depth direction of the groove 180 is vertical to the first connecting axle 110. The cam rotor 19 is driven by the motor M to rotate in the groove 180 for driving the sliding base 18 moving back and forth along an axial direction of the first connecting axle 110. In this embodiment, the sliding base 18, the fixed base 16 and the linkage rod 17 are disposed at the same side.

The surface of the cam rotor 19 is a cam surface for fitting the groove 180, and the motor M is connected to a cam shaft 191 of the cam rotor 19 for driving the cam rotor 19 to rotate in the groove 180. As shown in FIG. 3, when the axle end of the long axis of the cam rotor 19 is moving forward the direction far away the substrate transferring mechanism 1, the sliding base 18 is pushed outward, as the direction to the right in FIG. 3, thereby to drive the upper wiping unit 11 to move to the right through the connecting rod 20, and at the same time the linkage rod 17 is driving the lower wiping unit 12 to move to the left through the second connecting axle 120 under the linkage rod 17. When the axle end of the short axis of the cam rotor 19 is moving forward the direction far away the substrate transferring mechanism 1, the sliding base 18 is pushed inward, as the direction to the left in FIG. 3, thereby to drive the upper wiping unit 11 to move to the left through the connecting rod 20, and at the same time the linkage rod 17 is driving the lower wiping unit 12 to move to the right through the second connecting axle 120 under the linkage rod 17. Because the substrate P is transferred vertically to the wiping direction, when the motor M is operating continuously, the above steps would be performed repeatedly, thereby to continuously wipe the substrate P passing through.

In one embodiment, the wiping mechanism 3 further comprises a connecting rod 20, an axle coupling unit 21 and an auxiliary stand 22. One end of the connecting rod 20 is connecting to the sliding base 18 and another end of the connecting rod 20 is connecting to the first connecting axle 110 through the axle coupling unit 21. The connecting rod 20 is disposed to pass through inside the auxiliary stand 22 and is supported by the auxiliary stand 22. The auxiliary stand 22 also has the sleeve 15 embedded and fastened therein, and the sleeve 15 has a running fit with the connecting rod 20. In this kind of design, the driving mechanism and the wiping part of the wiping mechanism 3 could be designed separately and then assembled together, and when one of them is worn or damaged, it is convenient to maintain or replace, and the maintenance cost is also reduced at the same time.

In the present invention, by disposing the upper wiping unit and the lower wiping unit individually at the upper side and the lower side of the substrate to move back and forth for separately wiping the substrate, the moving directions of the upper wiping unit and the lower wiping unit are parallel to the loading plane for disposing the substrate and are vertical to a transmission direction of the substrate, and the moving directions of the upper wiping unit and the lower wiping unit are opposite to each other, thereby to prevent the substrate being shifted due to wiping, to guarantee the effect of cleaning foreign particles from the surface of the substrate and at the same time to avoid scratching the surface of the substrate, to prevent the cleaning apparatus from being damaged, and to avoid affecting the substrate transmission.

The foregoing contents are detailed description of the disclosure in conjunction with specific preferred embodiments and concrete embodiments of the disclosure are not limited to these descriptions. For the person skilled in the art of the disclosure, without departing from the concept of the disclosure, simple deductions or substitutions can be made and should be included in the protection scope of the application.

What is claimed is:

1. A wiping mechanism, for wiping a substrate disposed on a loading plane during transmission, comprising an upper wiping unit and a lower wiping unit, wherein, the substrate is transmitted along a transmission direction, the upper wiping unit and the lower wiping unit moves back and forth for separately wiping an upper side and a lower side of the substrate, moving directions of the upper wiping unit and the lower wiping unit are parallel to the loading plane and are vertical to the transmission direction, and the moving directions of the upper wiping unit and the lower wiping unit are opposite to each other, wherein the upper wiping unit and the lower wiping unit both include a backplate far away from the substrate and a wiping part fastened on an inner surface of the backplate, for contacting the backplate, wherein the wiping mechanism further comprises a left stand and a right stand disposed at two sides of the transmission direction of the substrate, wherein the upper wiping unit includes first connecting axles connected separately to two sides of the backplate, and the lower wiping unit includes second connecting axles connected separately to two sides of the backplate, the first connecting axles at two sides of the upper wiping unit and the second connecting axles at two sides of the lower wiping unit are individually plugged in and supported by the left stand and the right stand, wherein the wiping mechanism further comprises sleeves for individually slipping over each of the first connecting axles and each of the second connecting axles, wherein the sleeves are embedded and fastened in the corresponding left stand and the corresponding right stand.

2. The wiping mechanism according to claim 1, further comprising a fixed base fastened on one side of the right stand and a linkage rod rotatably connected to the fixed base at a middle portion of the linkage rod, wherein two sides of the linkage rod are separately hinge connected to the first connecting axle and the second connecting axle adjacent to the linkage rod.

3. The wiping mechanism according to claim 2, further comprising a sliding base connected with an end of one of the first connecting axles, a cam rotor embedded in the sliding base and a motor for driving the cam rotor to rotate, wherein the sliding base has a groove formed thereon, and a depth direction of the groove is vertical to the first connecting axle, the cam rotor is driven by the motor to rotate in the groove for driving the sliding base moving back and forth along an axial direction of the first connecting axle.

4. The wiping mechanism according to claim 3, further comprising a connecting rod, an axle coupling unit and an auxiliary stand, wherein one end of the connecting rod is connecting to the sliding base and another end of the connecting rod is connecting to the first connecting axle through the axle coupling unit, and the connecting rod is disposed to pass through inside the auxiliary stand and is supported by the auxiliary stand.

5. The wiping mechanism according to claim 1, wherein the wiping part is bristles.

6. A wiping mechanism, for wiping a substrate disposed on a loading plane during transmission, comprising an upper wiping unit and a lower wiping unit, wherein, the substrate is transmitted along a transmission direction, the upper wiping unit and the lower wiping unit moves back and forth for separately wiping an upper side and a lower side of the substrate, moving directions of the upper wiping unit and the lower wiping unit are parallel to the loading plane and are vertical to the transmission direction, and the moving directions of the upper wiping unit and the lower wiping unit are opposite to each other, wherein the upper wiping unit and the lower wiping unit both include a backplate far away from the substrate and a wiping part fastened on an inner surface of the backplate, for contacting the backplate, wherein the wiping mechanism further comprises a left stand and a right stand disposed at two sides of the transmission direction of the substrate, wherein the upper wiping unit includes first connecting axles connected separately to two sides of the backplate, and the lower wiping unit includes second connecting axles connected separately to two sides of the backplate, the first connecting axles at two sides of the upper wiping unit and the second connecting axles at two sides of the lower wiping unit are individually plugged in and supported by the left stand and the right stand, wherein the wiping mechanism further comprises a fixed base fastened on one side of the right stand and a linkage rod rotatably connected to the fixed base at a middle portion of the linkage rod, wherein two sides of the linkage rod are separately hinge connected to the first connecting axle and the second connecting axle adjacent to the linkage rod.

7. The wiping mechanism according to claim 6, further comprising a sliding base connected with an end of one of the first connecting axles, a cam rotor embedded in the sliding base and a motor for driving the cam rotor to rotate, wherein the sliding base has a groove formed thereon, and a depth direction of the groove is vertical to the first connecting axle, the cam rotor is driven by the motor to rotate in the groove for driving the sliding base moving back and forth along an axial direction of the first connecting axle.

8. The wiping mechanism according to claim 7, further comprising a connecting rod and an axle coupling unit, wherein one end of the connecting rod is connecting to the sliding base and another end of the connecting rod is connecting to the first connecting axle through the axle coupling unit.

9. The wiping mechanism according to claim 8, further comprising an auxiliary stand, wherein the connecting rod is disposed to pass through inside the auxiliary stand and is supported by the auxiliary stand.

10. The wiping mechanism according to claim 6, wherein the wiping part is bristles.

11. A substrate cleaning apparatus comprising:

a substrate transferring mechanism for loading a substrate on a loading plane and transferring the substrate loaded on the loading plane along a transmission direction;

a spraying mechanism disposed above the substrate transferring mechanism; and a wiping mechanism, comprising an upper wiping unit and a lower wiping unit, wherein the upper wiping unit and the lower wiping unit moves back and forth for separately wiping an upper side and a lower side of the substrate, moving directions of the upper wiping unit and the lower wiping unit are parallel to the loading plane and are vertical to the transmission direction, and the moving directions of the upper wiping unit and the lower wiping unit are opposite to each other, wherein the spraying mechanism is for spraying cleaning fluid on the substrate before the substrate is passing through the wiping mechanism, wherein the upper wiping unit and the lower wiping unit both include a backplate far away from the substrate and a wiping part fastened on an inner surface of the backplate, for contacting the backplate.

12. The substrate cleaning apparatus according to claim 11, wherein the wiping part is bristles.

13. The substrate cleaning apparatus according to claim 11, wherein the wiping mechanism further comprises a left stand and a right stand disposed at two sides of the transmission direction of the substrate, wherein the upper wiping unit includes first connecting axles connected separately to two sides of the backplate, and the lower wiping unit includes second connecting axles connected separately to two sides of the backplate, the first connecting axles at two sides of the upper wiping unit and the second connecting axles at two sides of the lower wiping unit are individually plugged in and supported by the left stand and the right stand.

14. The substrate cleaning apparatus according to claim 13, wherein the wiping mechanism further comprises sleeves for individually slipping over each the first connecting axle and each the second connecting axle, wherein the sleeves are embedded and fastened in the corresponding left stand and the corresponding right stand.

15. The substrate cleaning apparatus according to claim 13, wherein the wiping mechanism further comprises a fixed base fastened on one side of the right stand and a linkage rod rotatably connected to the fixed base at a middle portion of the linkage rod, wherein two sides of the linkage rod are separately hinge connected to the first connecting axle and the second connecting axle adjacent to the linkage rod.

16. The substrate cleaning apparatus according to claim 15, wherein the wiping mechanism further comprises a sliding base connected with an end of one of the first connecting axles, a cam rotor embedded in the sliding base and a motor for driving the cam rotor to rotate, wherein the sliding base has a groove formed thereon, and a depth direction of the groove is vertical to the first connecting axle, the cam rotor is driven by the motor to rotate in the groove for driving the sliding base moving back and forth along an axial direction of the first connecting axle.

17. The substrate cleaning apparatus according to claim 16, wherein the wiping mechanism further comprises a connecting rod, an axle coupling unit and an auxiliary stand, wherein one end of the connecting rod is connecting to the sliding base and another end of the connecting rod is connecting to the first connecting axle through the axle coupling unit, and the connecting rod is disposed to pass through inside the auxiliary stand and is supported by the auxiliary stand.

* * * * *